United States Patent [19]

Hahnewald

[11] Patent Number: 4,801,915

[45] Date of Patent: Jan. 31, 1989

[54] HEATING UNIT, IN PARTICULAR FOR BREAD TOASTERS

[75] Inventor: Andrea Hahnewald, Friedrichsdorf, Fed. Rep. of Germany

[73] Assignee: Braun Aktiengesellschaft, Kronberg, Fed. Rep. of Germany

[21] Appl. No.: 92,456

[22] Filed: Sep. 3, 1987

[30] Foreign Application Priority Data

Sep. 19, 1986 [DE] Fed. Rep. of Germany ..... 3631852

[51] Int. Cl.[4] ..... H01C 3/12

[52] U.S. Cl. ..... 338/293; 99/389; 219/355; 219/542

[58] Field of Search ..... 338/288, 289, 293, 48, 338/279, 280, 284; 219/354, 355, 542, 536, 553, 548, 552; 99/389, 385

[56] References Cited

U.S. PATENT DOCUMENTS

| | | | |
|---|---|---|---|
| 1,050,912 | 1/1913 | Bölling | 338/288 |
| 3,673,787 | 6/1972 | Drugmand et al. | 219/542 X |
| 4,588,976 | 5/1986 | Jaselli | 338/284 |

FOREIGN PATENT DOCUMENTS

| | | |
|---|---|---|
| 1490429 | 7/1969 | Fed. Rep. of Germany . |
| 2917808 | 11/1980 | Fed. Rep. of Germany . |

*Primary Examiner*—C. L. Albritton

[57] ABSTRACT

A heating unit, in particular for bread toasters, with a useful heat emitting area (2) and a waste heat emitting area (12), comprising an insulating body (1) and a heat conductor wound thereon. In bread toasters the efficiency of such heating units is considered unsatisfactory, and undue heating of the housing occurs since the radiation of heat in the waste heat emitting area is not directed to the material being toasted but to the housing walls. To avoid this shortcoming, it is proposed to short-circuit the heat conductor portions (12) extending in the waste heat emitting area.

8 Claims, 2 Drawing Sheets

FIG.1
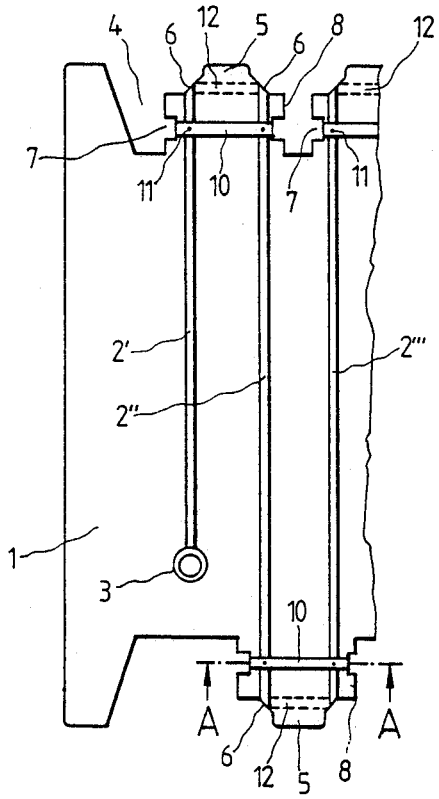
FIG.4
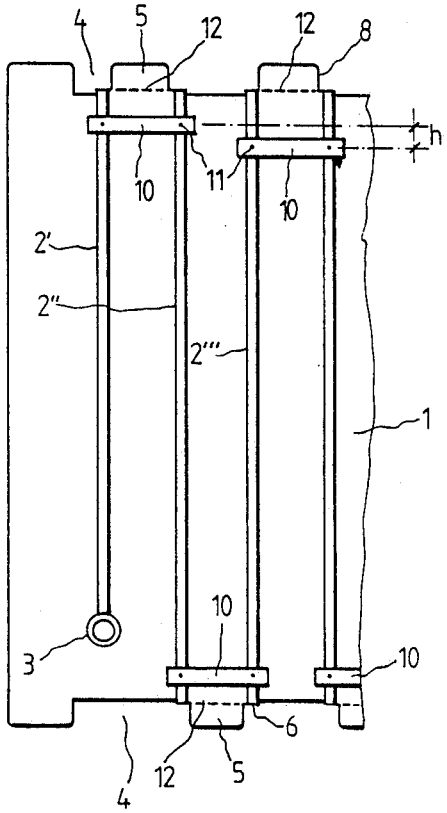
FIG.2
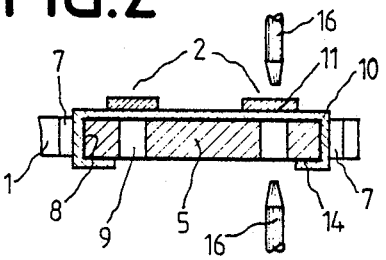
FIG.3
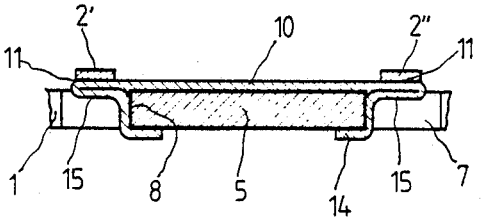
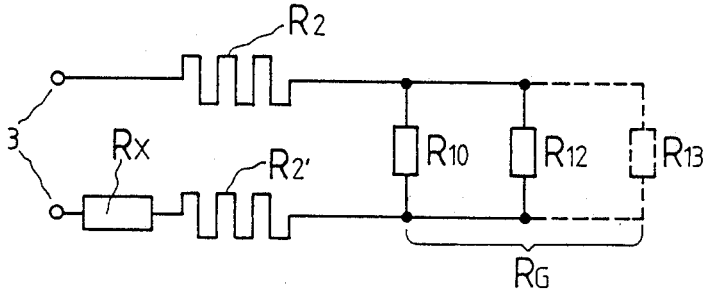
FIG.9

FIG.5
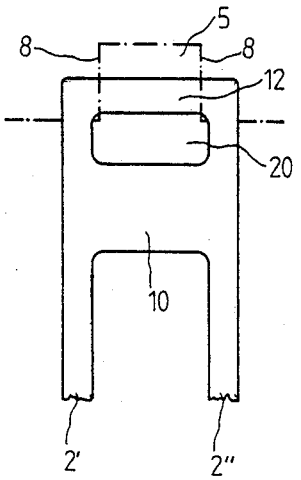
FIG.6
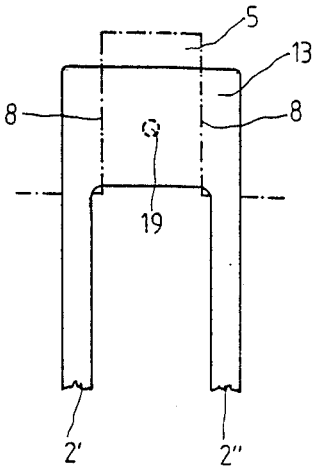
FIG.7
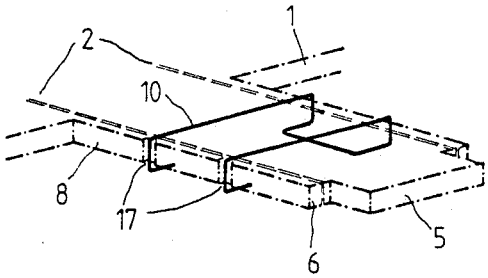
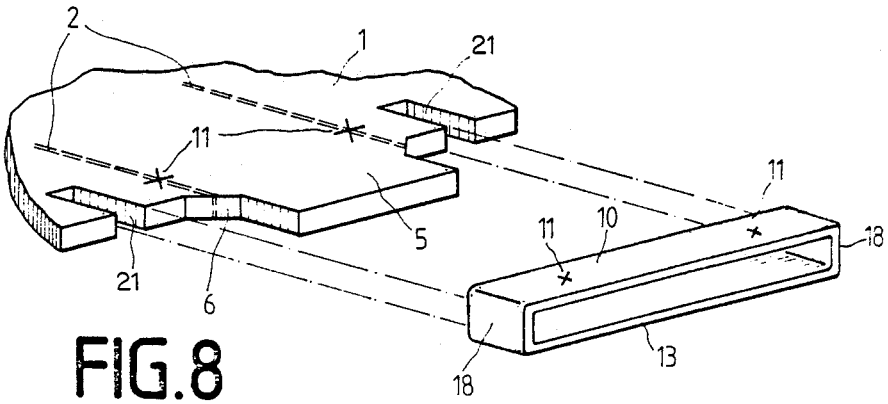
FIG.8

HEATING UNIT, IN PARTICULAR FOR BREAD TOASTERS

This invention relates to a heating unit in accordance with the preamble of patent claim 1.

Wound heating units usually have an area or side with a preferred heat emission. It is, however, unavoidable for several or individual sections of the complete heat conductor to represent waste sections since they run outside the preferred heat emission area. Such a winding pattern is necessary for a wide variety of reasons. For example, in a heating unit for a bread toaster having a plate-shaped body of insulating material provided with projections at the edges thereof, the heat conductor extends partly on the front of the insulating body and partly on its back in the region of the edge projections. The portion of the heat conductor extending on the front part of the insulating body is to be considered as the useful portion while the portion wound around or rearwardly engaging the projections on the back side of the insulating body is to be regarded as the waste portion. This winding pattern on the front and back at the edge projections affords the advantage of enabling the heat conductor to be mounted on the insulating body in a simple manner which is the reason why this mounting method is frequently used also on other heating units.

In this heating unit for a bread toaster heater so far described by way of example, the front part of the insulating body on which the useful heat conductor portions extend is the preferred heat emitting side. Thus, the main direction of heat radiation is substantially normal to the front part of the insulating body, with the insulating body itself providing a shield preventing radiation in the direction of the back side. On the other hand, the direction of radiation of the heat conductor portions extending in the region of the projections on the back of the insulating body is opposed to the direction of useful radiation. That is, the waste heat conductor portions on the back of the insulating body in the region of the projections unduly emit the heat to the appliance, heating, for example, the housing walls. The shielding effect of the projections does not permit the heat to be emitted in the useful direction. While the loss caused by the waste heat conductor portions may amount to between 10% and 20% and over of the total output of the heating unit, depending on their size, length, etc., the undesired heating of the surrounding housing parts is to be considered the main disadvantage.

It is, therefore, an object of this invention to provide a heating unit, in particular for bread toasters, with a wound heat conductor having portions extending on useful and waste sides of the insulating body, wherein the efficiency of the heat emission in the direction of the useful side is improved.

This object of the invention is accomplished by the features of the characterizing part of patent claim 1.

In accordance with the invention, all waste heat conductor portions extending on the waste side in terms of heat emission are short-circuited by a device, so that a total resistance of a waste heat conductor portion and a short-circuiting device each is smaller than the ohmic resistance of a waste heat conductor portion which is not bridged. The complete heat conductor is thus comprised of a specified number of serially connected useful heat conductor portions having inserted therebetween the waste heat conductor portions likewise arranged in series together with the parallel-connected short-circuiting devices. In consequence, an interval-type power output along the length of the heat conductor is obtained by the present invention. That is, an interval of increased heat emission corresponding to the length of the useful heat conductor portion is followed by an interval of reduced heat emission corresponding to the length of the bridged waste heat conductor portion. This arrangement advantageously permits the total resistance of the heat conductor to be maintained by raising the resistance of the waste heat conductor portion by the amount by which the total resistance provided by the waste heat conductor portions drops as a result of the short circuiting of the invention. This does not affect the total power requirements of the heat conductor, and an increased efficiency results since the losses are reduced.

A further advantage of the invention consists in that it provides the option to improve the strength of the transitions from the useful portions to the waste portions. In most arrangements, the waste portion is determined by the heat conductor being folded or bent around an edge of an insulating body. At the fold, the material of the heat conductor is thus not only subjected to thermal load but experiences in addition a mechanical load. This dual load increases the danger of the heat conductor becoming damaged at the fold and melting away, for example. By virtue of the invention, however, it is possible to position the contact points of the short-circuiting device with the heat conductor somewhat closer to the useful heat conductor portions and at some distance from the folds. While this contact arrangement shortens the useful heat conductor portion a small amount, it affords on the other hand the advantage of relieving the heat conductor at the folds or bending edges of electrical and mechanical loads. This contact arrangement is disclosed in an improvement of the invention.

From German published patent application DE-OS No. 1,490,429, a variable resistor is known having a meander-type conductor and a short-circuiting device. The short-circuiting device bridges across two adjacent resistor sections so that the short-circuiting device is connected in parallel with a specified section of the resistor. While DE-OS No. 1,490,429 discloses a short-circuiting device and a heat conductor of a heating unit is comparable to a resistor, the resistor disclosed in DE-OS 1,490,429 is by its spirit and purpose an adjustable resistor, there being no change in the spatial power distribution involved as in the invention.

The present invention will be explained in more detail in the following with reference to the accompanying drawings, in which:

FIG. 1 is a view of a first embodiment of a heating unit constructed in accordance with the invention;

FIG. 2 is a sectional view of a projection of an insulating body of a heating unit similar to the heating unit of FIG. 1, taken along the line A—A of that Figure;

FIG. 3 is a sectional view of a projection of another insulating body not shown;

FIG. 4 is a view of a second embodiment of a heating unit constructed in accordance with the invention;

FIG. 5 is a view of a flat short-circuiting device having a mounting eye;

FIG. 6 is a view of a flat short-circuiting device having a mounting hole;

FIG. 7 is a view of a short-circuiting device in the form of a spring clip;

FIG. 8 is a view of a short-circuiting device in the form of a sleeve; and

FIG. 9 an equivalent circuit diagram of a heating unit of the invention.

Referring now to FIG. 1 of the drawings, there is shown a first embodiment of a heating unit of the invention, taking a heating unit for a bread toaster as example. In FIG. 1, only the front part and a left section of the plate-shaped heating unit of the bread toaster are shown. The heating unit possesses an insulating body 1 in the form of a plate having on two opposite sides edge notches 4 formed such as to provide edge projections 5. As becomes apparent from FIG. 1, the upper projections 5 along the edge are arranged in a staggered relationship to the lower projections 5. Starting from an electrical terminal 3, a heating unit having a meandering winding pattern is provided on the insulating body 1. The heat conductor is comprised of useful heat conductor portions 2 arranged on the front part of the insulating body 1, and of waste heat conductor portions 12 extending on the back of the insulating body 1 in the region of the projections 5. In the following, the useful heat conductor portions 2 and the waste heat conductor portions 12 will be referred to as useful portions and waste portions, respectively. Being identical in strength and thickness of the material, the useful portions 2 are electrically connected in series with the waste portions 12, the heat conductor being a continuous wire wound onto the insulating body 1 in the manner illustrated in FIG. 1.

In accordance with the heat conductor winding pattern shown in FIG. 1, a useful portion 2' extends from the electrical terminal 3 to a first bending edge 6 at the first upper projection 5. The bending edge 6 has a gradient of 45°, and the heat conductor extends as useful portion 2' up to the bending edge 6 on the front part of the insulating body 1. The bending edge 6 enables the winding course of the heat conductor to be changed by 90° and to be continued on the back of the insulating body 1. There, the heat conductor extends as the first waste portion 12 from the first bending edge 6 of the upper projection 5 at right angles to the first useful portion 2' up to the second bending edge 6. From the second bending edge 6 of the upper projection 5, the heat conductor 2'' continues again on the front part of the insulating body 1, extending down to the first left bending edge 6 of the lower projection 5. Subsequently, the heat conductor extends again as a waste portion 12 on the back of the lower projection 5, continuing again as a useful portion 2''' at its right bending edge 6. In this embodiment, the useful portions 2 are thus in relative parallel arrangement, with the waste portions 12 being arranged on the back of the projections and interconnecting the individual useful portions 2 at the upper and lower edge alternately. Accordingly, the waste portions 12 extend parallel with the upper and lower edges of the insulating body 1 provided with the projections 5. The winding pattern of the heat conductor described thus far affords the advantage of a simple mounting of the heat conductor on the insulating body 1, which is accomplished by winding the heat conductor about the projections 5 and securing them from unwinding themselves by means of the electrical terminals 3. In this arrangement, the waste portions 12 extend such as to rearwardly engage the projections 5 serving to mount the heat conductor.

In accordance with the winding pattern of the heat conductor or its division into useful and waste portions 2 and 12, respectively, there results a spatially different power distribution and heat emission on the heating unit so far described. The front part of the insulating body 1 on which the useful portions 2 are provided is to be regarded as the useful heat emitting area, whilst the waste portions 12 extending on the back of the projections 5 are to be considered as waste heat emitting areas, since the waste portions 12 do not heat the material being toasted, an emission of heat from the waste portions 12 to the material being toasted being prevented by the shielding effect of the projections 5. The waste portions 12 have the unwanted effect of contributing to an unnecessary heating of surrounding housing parts—as, for instance, the outer walls of the bread toaster. Also, the overall efficiency of the heating unit described so far is reduced as compared with a heating unit having no winding sections in the form of the waste portions 12 on the back of the insulating body 1. The losses incurred by the waste portions 12 depend on their number, their length and thus on their ohmic resistance compared to the ohmic resistance of the useful portions 2.

As further shown in FIG. 1, short-circuiting devices 10 will be recognized in the region of the projections 5, each device interconnecting a pair of adjacent useful portions 2 of the heat conductor. For example, the short-circuiting device 10 on the upper left projection 5 interconnects the two useful portions 2' and 2'', the short-circuiting device 10 being electrically connected to the useful portions 2 at contact points 11. The ohmic resistance of a short-circuiting device 10 is substantially smaller than or at best of the same magnitude as the ohmic resistance of a waste portion 12. Accordingly one short-circuiting device 10 each is connected in parallel with a waste portion 12 and acts as a shunt.

The short-circuiting device 10 of FIG. 1 is configured as a clip for the secure fastening of which the longitudinal flanks 8 of the projections 5 are provided with indentations 7 into which the clips are bent. FIG. 2 shows a section of a projection 5 of the heating unit of FIG. 1, taken along the line A—A of that Figure. Unlike FIG. 1, however, the useful portions 2 of the heat conductor are formed above the clip-shaped short-circuiting device 10, thus being in abutting engagement with the short-circuiting device 10. In FIG. 1, the useful portions are formed intermediate the short-circuiting device 10 and the insulating body 1. As becomes further apparent from FIG. 2, the free ends 14 of the clip-shaped short-circuiting device 10 engage from the front part of the insulating body 1 into the indentations 7, the free ends 14 thus embracing the projection 5 and extending up to the back side of the projection 5. For example, to secure the heat conductor to the short-circuiting device in the contact points 11, two bores 9 are provided in the projections 5. The heat conductor and the short-circuiting device 10 are welded together in the contact points 11 by means of an electrode 16 passed from the back of the insulating body 1 through the bore 9 to the short-circuiting device 10 and by means of another electrode 16 applied to the heat conductor from above.

FIG. 3 shows a further embodiment of a clip-shaped short-circuiting device 10 in section, the clip being bent back in the region of the contact points 11 to form a fold 15 the free ends 14 of which embrace again the projection 5. As further shown in FIG. 3, the folds 15 are arranged in such a manner that the useful portions 2 of the heat conductor come into contact with the folds 15 without being bent into the indentations 7 and extending in a straight line. That is, the upper side of the folds 15 lies in the region of the upper sides of the insulating body 1. In the welding operation establishing the contacts, the folds 15 provide an abutment for the useful heat conductor portions which can thus be connected with the folds 15 more easily than would be the case if, for example, the folds 15 were arranged in the middle along the thick part of the insulating body 1. Accordingly, an additional operation for bending the useful portions down onto the folds 15 is not necessary. By these means, the need to press the useful portions 2 into the indentations 7 during the welding operation is eliminated.

FIG. 4 shows a further embodiment of a heating unit of the invention. Parts of the heating unit of FIG. 4 corresponding to those of FIG. 1 are identified by like reference numerals. Unlike FIG. 1, the projections 5 of FIG. 4 are configured as simple lugs having no suitably formed bending edges 6. This makes the insulating body 1 of FIG. 4 easier to manufacture. A further essential difference to the heating unit of FIG. 1 resides in the fact that in FIG. 4 the short-circuiting devices 10 are not provided on the projections 5 but in the edge region of the insulating body 1. For example, the short-circuiting devices 10 of FIG. 4 may be metal strips placed on the heat conductor winding and welded thereto in contact points 11. The short-circuiting devices 10 may also be cramps having their free ends forced through the insulating material to the back side to be subsequently secured by bending.

In FIG. 1, the useful portions 2 have been defined as the length of the heat conductor between two opposed bending edges 6. Depending on how the spatial heat emission characteristic of the heating unit is to be used, waste areas may also exist on the main side of radiation of the heating unit. In the heating unit shown in FIG. 4 by way of example, the edge regions on the front part of the insulating body 1, which is the main side of radiation of the heating unit, are likewise to be regarded as waste areas. For example, with the heating unit standing upright and the air heated in the bottom part moving upwards, it is not absolutely necessary for the heating unit to radiate heat in the upper edge region on the useful side because this heat is allowed to leave the range of effectiveness of the heating unit too quickly. Accordingly, it is possible for example to provide the upper short-circuiting devices 10 at a somewhat larger distance from the upper edge than the lower short-circuiting devices from the lower edge. Also, the short-circuiting devices 10 provided along the edge need not necessarily be on a common imaginary line but may be arranged at various locations on the insulating body 1 to balance the spatial radiation characteristic of the heating unit—for example, at different distances from the edge as indicated in FIG. 4 by distance "h" between the upper two short-circuiting devices 10. Accordingly, heat conductor portions extending in undue radiation areas of the heating unit are to be counted among waste portions 12 also when they extend on the main side of radiation of the heating unit. Therefore, in the heating unit for a bread toaster as illustrated in FIG. 4 by way of example, following contacting of the short-circuiting devices 10, those heat conductor portions are to be considered as useful portions that extend between the contact points 11 of an upper and a lower short-circuiting device 10. Accordingly, in FIG. 4 those heat conductor portions are to be considered as waste portions that lie outside the area thus defined. Another possibility of balancing the radiation characteristic of the heating unit consists in that the short-circuiting devices 10, in addition to being arranged at different locations, have different ohmic resistances at comparable points, which is easily accomplished, for example, by providing short-circuiting devices 10 of different widths or by arranging the short-circuiting devices 10 in pairs.

The embodiments of short-circuiting devices 10 described so far in which the heat conductor is clamped in place between the short-circuiting device 10 and the insulating body 1 afford the advantage of an additional securing means for the heat conductor. It is to be considered that an increased mechanical and electrical load occurs in particular at the bending or deflecting edges where the heat conductor changes its winding course, which load often causes melting away of the heat conductor at these points. In wound heating units described so far, in the absence of the short-circuiting devices 10 the heat conductor would slacken and automatically unwind itself from the projections 5 which serve as mounting means. This entails the risk that live sections of the heat conductor may create a short circuit condition or a safety hazard. Thus, a heating unit of the invention which is equipped with the short-circuiting devices 10 avoids automatic unwinding and slackening of the entire heat conductor.

FIG. 5 shows a detail of another heating unit in which the heat conductor is fabricated of a flat piece of sheet metal. Of the insulating body 1, a projection is shown in FIG. 5 in a dot-and-dash line. As in the embodiments of FIGS. 1 and 4 previously described, the waste portion 12 rearwardly engages the projection 5 on the back of the insulating body 1. Again, a short-circuiting device 10 is provided on the front part intermediate the two useful portions 2 of the heat conductor. In contrast with the short-circuiting devices 10 described in the foregoing, the short-circuiting device 10 shown in FIG. 5 forms a unitary piece of material with the other heat conductor portions 2, 12. The short-circuiting device 10 is formed, for example, by providing a window or cutout 20 in the loop end filled between the two useful portions 2 with material over a large area, which window is dimensioned such as to allow insertion of the projection 5. Such a heat conductor can be manufactured by punching, etching or laser beam techniques, for example. The assembly of a heat conductor of this type having waste portions 12 at the upper and lower edges, windows 20 and short-circuiting devices 10 is accomplished, for example, by forming the insulating body 1 of two superposable plates which are riveted together after the projections 5 have been hooked into the windows 20 at the edges.

FIG. 6 shows a short-circuiting device 13 which is arranged on the waste or back side of the heating unit. Similar to the embodiment described with reference to FIG. 5, the heat conductor is fabricated of a single piece of sheet metal, the loop end does not, however, have the window 20 previously described. By contrast, in this embodiment the waste portion 12 extending on the back side and the short-circuiting device 10 coincide to form the correspondingly broad short-circuiting device 13 which rearwardly engages the projection 5 (shown in the dot-and-dash line) for mounting, the added effect being a smaller loss. Depending on whether the short-circuiting device is arranged on the front or back of the heating unit described by way of example, the short-circuiting device will be referred to by reference numeral 10 (front part) or, alternatively, reference numeral 13 (back). As an additional means for fastening the heat conductor to the insulating body 1, a rivet, for example, may be provided as indicated in FIG. 6 at 9.

Further, FIG. 7 shows a projection 5 in perspective view, with a spring clip provided on the front part of the insulating body 1 being used as a short-circuiting device 10. The spring clip is snap-fastened across the projection 5 over its longitudinal flanks 8 as a result of which the transverse sections of the spring clip cross and bridge the useful portions 2 of the heat conductor the winding pattern of which is shown by way of example. To securely mount the spring clip, grooves 17 are provided at the longitudinal flanks 8 of the projections 5, which grooves correspond to the indentations 7 of FIG. 1. While in FIG. 7 the short-circuiting device in the form of the spring clip is made of a piece of spring wire, it is, however, also possible to manufacture the spring clip of a strip of sheet metal having the properties of a spring should the spring wire lose its spring properties due to the effect of heat. Equally, it is possible to wedge an additional piece of sheet metal between the spring clip and the heat conductors, which piece short-circuits the heat conductors and is secured in position by the spring clip 17.

FIG. 8 shows in perspective view a projection 5 with an annular short-circuiting device. This short-circuiting device is a sleeve of rectangular cross section having an upper short-circuiting wall 10 and an opposite lower short-circuiting wall 13, the two walls being interconnected by side walls 18. To enable the short-circuiting device of FIG. 8 to be slipped onto the projection 5 to thereby register with the heat conductors in contact points 11, parallel recesses 21 are provided in the insulating body 1 adjacent to the heat conductors shown (in broken lines). As the short-circuiting device is pushed on the side walls 18 will thus engage into the recesses 21 whereupon the short-circuiting device is, for example, welded to the heat conductors or deformed in such a manner as to ensure a safe abutting contact. It is also possible to provide a short-circuiting device in the form of a closed metal cap which is slipped onto the projection 5 and the heat conductor portions, contacted and secured. In another embodiment, the short-circuiting device is of U-shaped cross section likewise slipped onto the projection 5 with its open end in the manner of a cap. The advantage of the short-circuiting devices described with reference to FIG. 8 resides in that they provide a large contact area between the heat conductor portions and the short-circuiting device on the front and back sides.

FIG. 9 shows an equivalent circuit diagram of a heating unit of the invention. In this diagram, the heat conductor portions and short-circuiting devices are assigned the same reference numerals as in the foregoing description. Starting from the upper electrical terminal 3 of the heating unit, the first useful portion begins with useful resistor R2. According to FIG. 1, the first useful resistor R2 would be followed by a loss resistor R12 which is followed by another useful resistor R2. To simplify the equivalent circuit diagram, the remaining series-connected resistors are combined to resistor RX. In accordance with the invention, the two short-circuit resistors R10 and R13 are connected in parallel with the loss resistor R12. In FIG. 9, the short-circuit resistor R13 is only shown in broken lines because in some of the embodiments previously described no short-circuit resistor was provided on the back side. The short-circuit resistors combine with the loss resistor R12 to provide a total resistance RG which is computed as a parallel circuit. If in the winding pattern previously described all loss resistors R12 are provided with short-circuit resistors, a resistance RG will be present between every two resistors R2. In respect of the complete heating unit intermediate the terminals 3, there alternates in fact always a useful resistor R2 and a loss resistor RG connected in series. As described in the foregoing, in addition to providing the advantage of balancing the spatial radiation characteristic, a heating unit of the invention also reduces the losses, which shall be explained in more detail in the following with reference to a computation example. This example refers to a conventional heating unit for a bread toaster having useful resistors R2 and loss resistors R12, with a total of, for example, 20 useful resistors R2 and 20 loss resistors R12 being provided. Further, the total resistance of a heating unit to be measured at the terminals 3 without short-circuited loss resistors is identified by **R3*a* and the total resistance of a heating unit of the invention is identified by R3*b*, with only one short-circuit resistor R10 each being assigned to one loss resistor R12**.

For a conventional bread toaster heating unit, the following computation applies:

| | |
|---|---|
| $R3a = n \cdot R2 + m \cdot R\,12;$ | $n = m = 20$ |
| $= n\,(R2 + R12)$ | $R2 = 2.25$ ohms |
| | $R12 = 0.25$ ohms |
| $= 20 \cdot 2.5$ | |
| $R3a = 50$ ohms | |

For a bread toaster heating unit having bridged waste heat conductor portions as disclosed in the invention, the following applies with the total resistance $R3b = 50$ ohms being unchanged:

| | |
|---|---|
| $R3b = n \cdot R2' + m \cdot RG;$ | $n = m = 20$ |
| $RG = R12 \cdot R10/(R12 + R10)$ | $R12 = 0.25$ ohms |
| | $R10 = 0.25$ ohms |
| $= 0.25 \cdot 0.25/0.5$ | |
| $RG = 0.125$ ohms | |
| $n \cdot R2' = R3b - m \cdot RG$ | |
| $= 50 - 2.5$ | |
| $n \cdot R2' = 47.5$ ohms | |
| $R2' = 47.5/20 = 2.375$ ohms | |

Assuming that the total resistance is to remain identical for both bread toaster heating units, the total resistance R2' of the useful heat conductor portions has to become greater by the amount by which the waste portions become smaller. Accordingly, for conventional heating units a power ratio P12/P2 results as follows:

$$\frac{P12}{P2} = \frac{n \cdot R12 \cdot i}{n \cdot R2 \cdot i} = \frac{0.25}{2.25} = 0.11;$$

whereas in a heating unit of the invention, the power ratio PG/P2 results as follows:

$$\frac{PG}{P2'} = \frac{n \cdot RG \cdot i}{n \cdot R2' \cdot i} = \frac{0.125}{2.375} = 0.053$$

Thus, with the total power consumption remaining unchanged and the loss resistor R12 being bridged by a short-circuit resistor R10 of the same rating, the power loss of the heating unit of the invention is about 50% less than in a conventional heating unit. If the short-circuit resistance R10 is reduced still further, the power loss will also be further reduced. On the other hand, when bridging the loss resistor R12 with a short-circuit resistor R10 of the same rating, the power loss will be reduced by 45% if the total resistance is not balanced through an alteration of the useful resistor R2. In this case, the current flow will increase due to the lower total resistance, this increased amount resulting in a power loss at the parallel circuitry RG comprised of useful resistor R12 and short-circuit resistor R10 which is somewhat higher than in the heating unit in which the useful resistance R10 was increased to maintain the total resistance. For example, if the heating power of the bread toaster heating unit is about 970 watts, the power loss savings are in the range of 50 watts using a parallel circuitry of two resistors R10, R12 of the same rating.

I claim:

1. An electric heating unit, in particular for bread toasters, with a useful heat emitting area and a waste heat emitting area, comprising an insulating body of plate-shaped configuration having projections (5) formed at the upper and lower edge, and an integrally formed heat conductor having a relatively high specific electrical resistance fitted to the insulating body and extending in at least two spans, said heat conductor including serially connected useful heat conductor portions which extend in the useful heat emitting area and waste heat conductor portions of the same materials as said useful heat conductor portions which extend in the waste heat emitting area, said waste heat conductor portions (12) rearwardly engaging said projections (5), and short-circuiting devices (10, 13) electrically connecting two adjacent spans (2, 2″ and 2′, 2‴) of the heat conductor (2) at its point of transition from the useful heat emitting area to the waste heat emitting area.

2. A heating unit as claimed in claim 1, characterized in that the contact points (11) of the short-circuiting devices (10) are still provided in the area of the useful heat conductor portions and thus before the bending points caused by the rearward engagement or embracing of the projections (5).

3. An electric heating unit as claimed in claim 1, characterized in that the electrical resistance of the short-circuiting devices (10, 13) is lower than that of the corresponding waste heat conductor portions (12).

4. An electric heating unit as claimed in claim 1, characterized in that the resistance of the useful heat conductor portions (2′, 2″, 2‴) is increased by the amount by which the total resistance of the heating unit is reduced as a result of the provision of the short-circuiting device (10, 13).

5. A heating unit as claimed in claim 1, characterized in the short-circuiting devices (10) are configured as clips the free ends (14) of which embrace indentations (7) provided on longitudinal flanks (8) of the projections (5).

6. A heating unit as claimed in claim 1 characterized in that the short-circuiting devices (10, 13) are configured as strip-shaped material extensions formed in the heat conductor (2) itself.

7. A heating unit as claimed in claim 6, characterized in that the material extensions are provided with cutouts (20) serving to suspend the heat conductor (2) on the projections (5).

8. A heating unit as claimed in claim 1 characterized in that the short-circuiting devices (10, 13) are part of a sleeve which is adapted to be slipped on the projection (5) and the side walls (18) of which sleeve engage into recesses (21) formed in the insulating body (1), such that the short-circuiting devices (10 and 13, respectively) can be electrically contacted with the respective useful and waste portions (2 and 12, respectively) by spot welding, for example.

* * * * *